US006953356B2

(12) United States Patent
Hisamatsu et al.

(10) Patent No.: US 6,953,356 B2
(45) Date of Patent: Oct. 11, 2005

(54) LOCK RELEASE MECHANISM USING PULL-TAB AND CONNECTOR HAVING THE LOCK RELEASE MECHANISM

(75) Inventors: Kazuhito Hisamatsu, Akiruno (JP); Akira Kimura, Kokubunji (JP); Nobukazu Kato, Fussa (JP); Tomohiko Tamada, Hamura (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 8 days.

(21) Appl. No.: 10/287,925

(22) Filed: Nov. 5, 2002

(65) Prior Publication Data

US 2003/0148647 A1 Aug. 7, 2003

(30) Foreign Application Priority Data

Feb. 1, 2002 (JP) ..... 2002-025056
Mar. 11, 2002 (JP) ..... 2002-065647

(51) Int. Cl.[7] ..... H01R 13/62
(52) U.S. Cl. ..... 439/258; 439/352
(58) Field of Search ..... 439/358, 258, 439/352, 353, 357

(56) References Cited

U.S. PATENT DOCUMENTS 3,458,850 A * 7/1969 Calisher ..... 439/258
3,953,098 A * 4/1976 Avery et al. ..... 439/258
4,083,619 A * 4/1978 McCormick et al. ..... 439/310
4,421,373 A * 12/1983 Ratchford et al. ..... 439/271
4,521,064 A * 6/1985 Knapp et al. ..... 439/153
4,605,271 A * 8/1986 Burns ..... 439/160
5,314,347 A * 5/1994 Colleran et al. ..... 439/350
5,752,850 A 5/1998 Ziegler
6,146,164 A 11/2000 Tung
6,146,179 A * 11/2000 Denny et al. ..... 439/352
6,197,642 B1 3/2001 Yeh et al.
6,447,170 B1 * 9/2002 Takahashi et al. ..... 385/53

FOREIGN PATENT DOCUMENTS

| | | |
|---|---|---|
| FR | 2 385 293 | 10/1978 |
| JP | 53-128889 | 3/1952 |
| JP | 06-052924 | 2/1994 |
| JP | 11-149956 | 6/1999 |
| JP | 11-297411 | 10/1999 |

* cited by examiner

*Primary Examiner*—Khiem Ngyen
(74) *Attorney, Agent, or Firm*—Collard & Roe, P.C.

(57) ABSTRACT

A lock release mechanism for releasing an engagement with a counterpart connector (10) by moving a lock lever (2) engaging with the counterpart connector (10). A pull-tab (6) is connected to the lock lever. The lock lever is moved by a force pulling the pull-tab.

24 Claims, 14 Drawing Sheets

LOCK RELEASE MECHANISM USING PULL-TAB AND CONNECTOR HAVING THE LOCK RELEASE MECHANISM

BACKGROUND OF THE INVENTION

The present invention relates to a lock release mechanism for moving a movable lock mechanism engaging with a counterpart member to release the engagement with the counterpart member. This lock release mechanism is suitable for use in connectors of various types.

For example, there has been available a connector having a lock mechanism for retaining a connected state with a counterpart connector. In the connector of this type, the lock mechanism engages with the counterpart connector upon coupling therebetween, thereby to inhibit the release from each other. When releasing the connection therebetween, the lock mechanism is moved through an operation by fingers or the like to release the engagement with the counterpart connector. With this arrangement, the connector can be easily detached from the counterpart connector.

Recently, the high density assembling has been generally implemented with respect to components such as connectors, and various devices. When the high density assembling is carried out, components are disposed near a lock mechanism so that it is sometimes difficult to directly operate the lock mechanism using fingers. In addition, there has also been a problem that the fingers may abut against components rather than the lock mechanism upon trying to operate the lock mechanism, thereby to accidentally cause breakage of those components.

There has been a further problem that, if a detaching mechanism or an operating portion is provided on the upper side of the assembly, an excessive space is required therefor, which is not suitable for the high density assembling.

SUMMARY OF THE INVENTION

It is therefore an object of the present invention to provide a lock release mechanism that has been remarkably improved in lock release operation, while ensuring the high density assembling of components or devices.

It is another object of the present invention to provide a connector with a lock having the foregoing lock release mechanism.

Other objects of the present invention will become clear as the description proceeds.

According to one aspect of the present invention, there is provided a lock release mechanism for releasing an engagement with a counterpart member by moving a movable lock mechanism engaging with the counterpart member, the lock release mechanism comprising a pull-tab connected to the lock mechanism, wherein the lock mechanism is moved by a force pulling the pull-tab, thereby to release the engagement with the counterpart member.

According to another aspect of the present invention, there is provided a lock release mechanism for releasing an engagement with a counterpart member by moving two movable lock mechanisms engaging with the counterpart member, the lock release mechanism comprising a pull-tab in the form of a flexible elongate member having both ends connected to the two lock mechanisms, wherein the lock mechanisms are moved by components of a force pulling the pull-tab, thereby to release the engagement with the counterpart member.

According to another aspect of the present invention, there is provided a connector which comprises a connector body for connecting to a counterpart connector, a mechanism connected to the connector body for engaging with the counterpart connector, the mechanism serving as the lock mechanism described above, and the above-mentioned lock release mechanism.

DESCRIPTION OF THE PREFERRED EMBODIMENTS

Figure 1A:
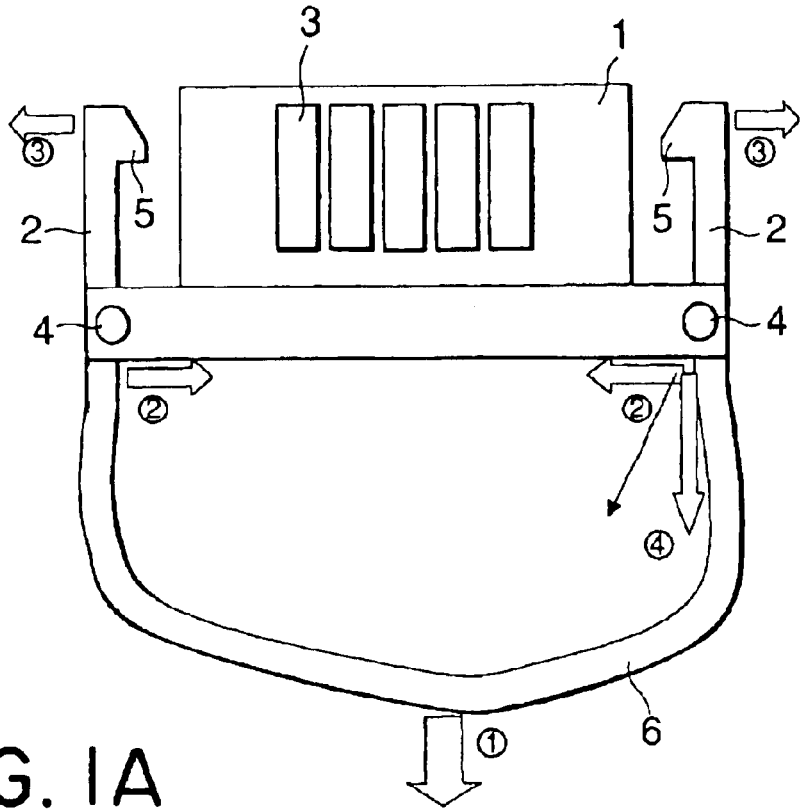
FIG. 1A is a plan view showing a schematic structure of a connector provided with a lock release mechanism according to a first embodiment of the present invention.
Figure 1B:
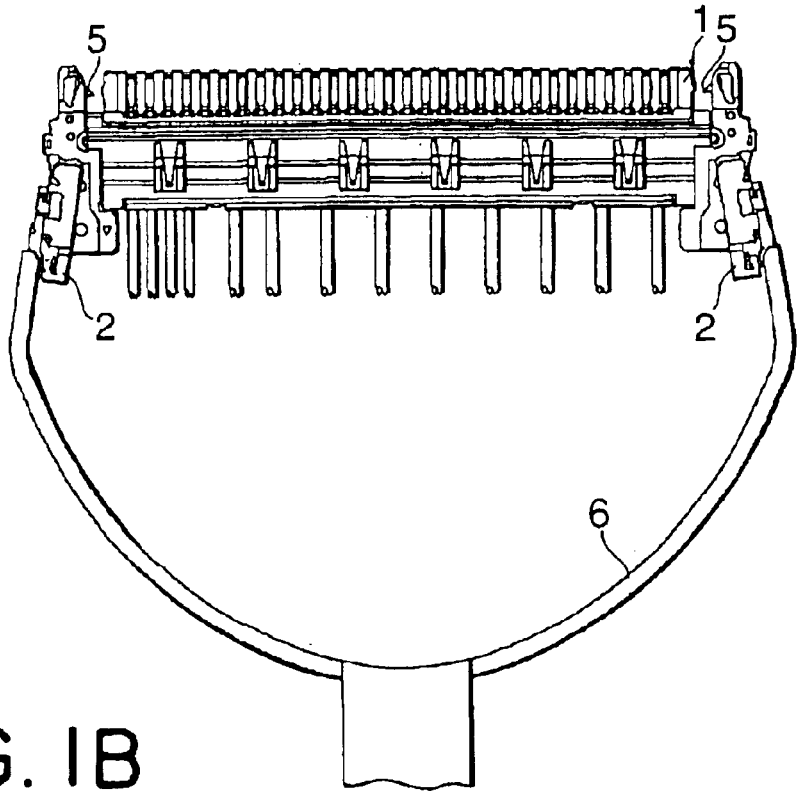
FIG. 1B is a plan view showing a concrete structure of the connector shown in FIG. 1A.

Referring to FIGS. 1A and 1B, a connector having a lock release mechanism according to a first embodiment of the present invention will be described.

The connector shown in FIGS. 1A and 1B comprises a connector body 1 and a pair of lock mechanisms or lock levers 2 made of plastics and attached to the connector body 1 at both lateral ends thereof. The connector body 1 comprises an insulating housing retaining therein a plurality of conductive contacts 3 (shown exemplarily) that are laterally arranged side by side. Each lock lever 2 is pivotable relative to the connector body 1 by means of a pivot axle 4 and is provided with an inward engaging claw 5 at its one end. The engaging claws 5 are provided for the purpose of engaging with corresponding engaging portions, in the form of concave portions or the like, provided on the lateral sides of a counterpart connector (not shown here) to be connected to the connector body 1.

The lock release mechanism comprises a pull-tab 6 connected to the lock levers 2. More particularly, the pull-tab 6 has its both ends formed integral with the other ends of the pair of lock levers 2. The pull-tab 6 serves as a lock release operating portion or a detaching member. The pull-tab 6 is a member having elasticity or resilience and extending between the pair of lock levers 2. It may, of course, also be arranged that a pull-tab in the form of an elongate member prepared separately is integrally attached to the lock levers 2.

When the connector body 1 interfits with the counterpart connector for connection therebetween, the lock levers 2 engage with the engaging portions of the counterpart connector. This engaging motion is carried out in conjunction with the pivotal motion of the lock levers 2 using the pivot axles 4 as fulcrums. The engagement between the lock levers 2 and the engaging portions of the counterpart connector is retained by means of the resilience of the pull-tab 6. Thus, the connector body 1 and the counterpart connector are prevented from accidentally disconnecting from each other.

For detaching the connector body 1 from the counterpart connector, the center portion of the pull-tab 6 is pulled by fingers in a direction as shown by an arrow ①. A force upon pulling in the direction of the arrow ① is converted into forces in directions as shown by arrows ② and ④. By the force in the direction of the arrow ②, moment is exerted on each lock lever 2 in a direction as shown by an arrow ③. As a result, the lock levers 2 pivot about the pivot axles 4, respectively, so that the engagement with the engaging portions of the counterpart connector, i.e. the locked state therebetween, is released. Further, by the force in the direction of the arrow ④, the connector body 1 is completely detached from the counterpart connector.

Figure 2:
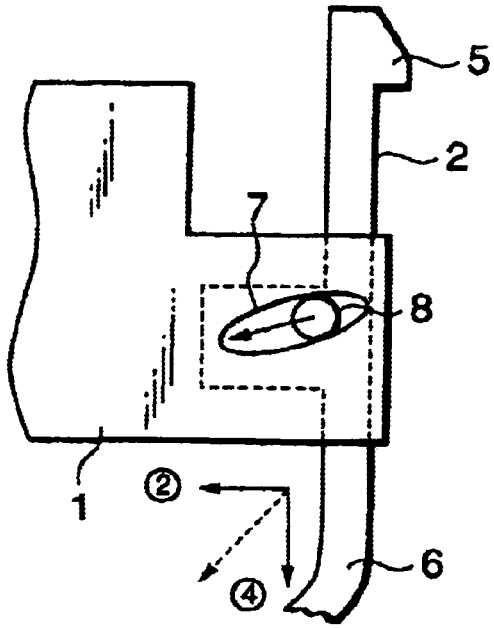
FIG. 2 is a plan view showing a schematic structure of only the main part of a connector provided with a lock release mechanism according to a second embodiment of the present invention.

Referring now to FIG. 2, a connector having a lock release mechanism according to a second embodiment of the present invention will be described. The same or similar portions or components are assigned the same reference symbols so as to omit explanation thereof.

In the connector of FIG. 2, a connector body 1 is formed with elongate grooves 7, and an axle portion 8 formed integral with each of lock levers 2 is inserted into the corresponding elongate groove 7.

When a pull-tab 6 is pulled as in the foregoing manner, the force is converted into forces of arrows ② and ④. The force of the arrow ② moves each lock lever 2 inward to release the locked state, and the force of the arrow ④ detaches the connector body 1 from the counterpart connector. In this case, each lock lever 2 makes a sliding motion upon operation thereof, but not a pivotal motion. Specifically, when connecting or disconnecting the connector body 1 relative to the counterpart connector, the axle portion 8 of each lock lever 2 slides along the elongate groove 7 of the connector body 1. For enabling the connection or disconnection according to this structure, engaging claws 5 of the lock levers 2 are formed so as to face outward, which is opposite to the facing directions of the engaging claws 5 shown in FIG. 1.

Figure 3B:
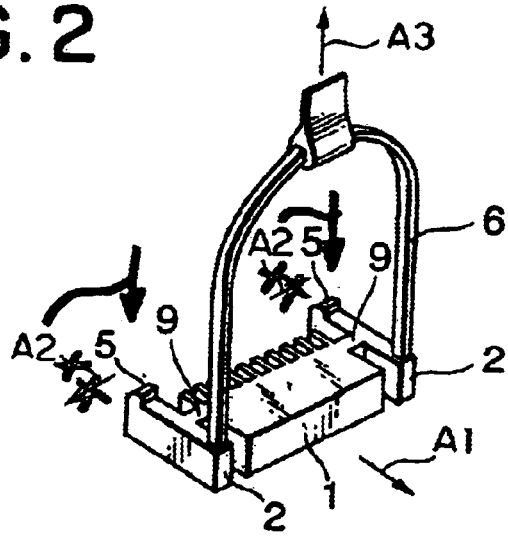
FIG. 3B is a perspective view for explaining a second modification.
Figure 3A:
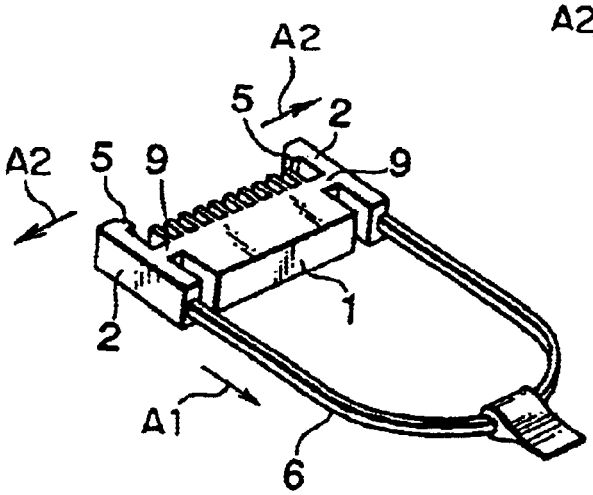
FIG. 3A is a perspective view for explaining a first modification.

As shown in modifications illustrated in FIGS. 3A and 3B, a connector body 1, lock levers 2 and a pull-tab 6 can be formed integral with each other using a plastic injection technique or the like. In this case, connecting portions 9 connecting the connector body 1 to the lock levers 2 are designed to have resilience such that the lock levers 2 are movable or pivotable relative to the connector body 1.

The pull-tab 6 may be prepared separately from the connector body 1. Further, the pull-tab 6 may have a semicircular shape. For the purpose of preventing interference with other components or improving operability (seizability), the pull-tab 6 may, of course, have another shape selected from among various shapes.

In FIG. 3A, assuming that the connector body 1 is disconnected from the counterpart connector in a first direction A1, each lock lever 2 is designed to be movable in a second direction A2 perpendicular to the first direction A1, and the pull-tab 6 is designed to be pulled in the first direction A1.

On the other hand, in FIG. 3B, assuming that the connector body 1 is disconnected from the counterpart connector in a first direction A1, each lock lever 2 is designed to make the engaging claw 5 be movable with respect to connecting portion 9 in a second direction A2 perpendicular to the first direction A1, and the pull-tab 6 is designed to be pulled in a third direction A3 parallel to and opposite to the second direction A2.

Referring now to FIGS. 4 to 8, a connector having a lock release mechanism according to a third embodiment of the present invention will be described. The same or similar portions or components are assigned the same reference symbols so as to omit explanation thereof.

Figure 4:
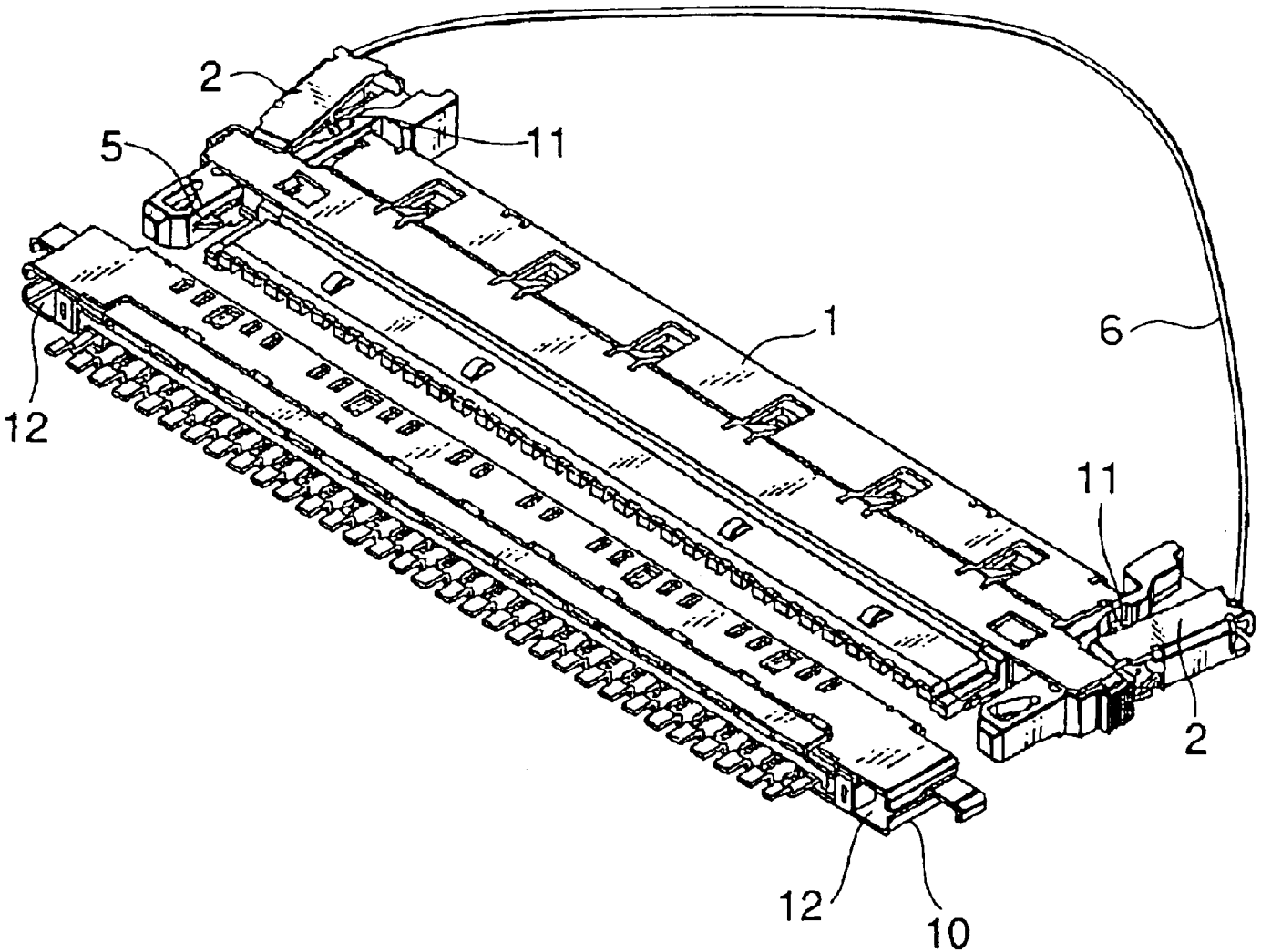
FIG. 4 is a perspective view showing a connector provided with a lock release mechanism according to a third embodiment of the present invention, along with a counterpart connector in a non-connected state.

In this embodiment, a pull-tab 6 is in the form of a flexible thin cable or a string member and has its both ends connected to pivotal ends of a pair of lock levers 2 by soldering. In a non-interfitting state where a connector body 1 does not interfit with a counterpart connector 10 as shown in FIG. 4, the lock levers 2 are biased by plate springs 11 serving as biasing means in directions in which engaging claws 5 of the lock levers 2 approach each other.

Figure 5:
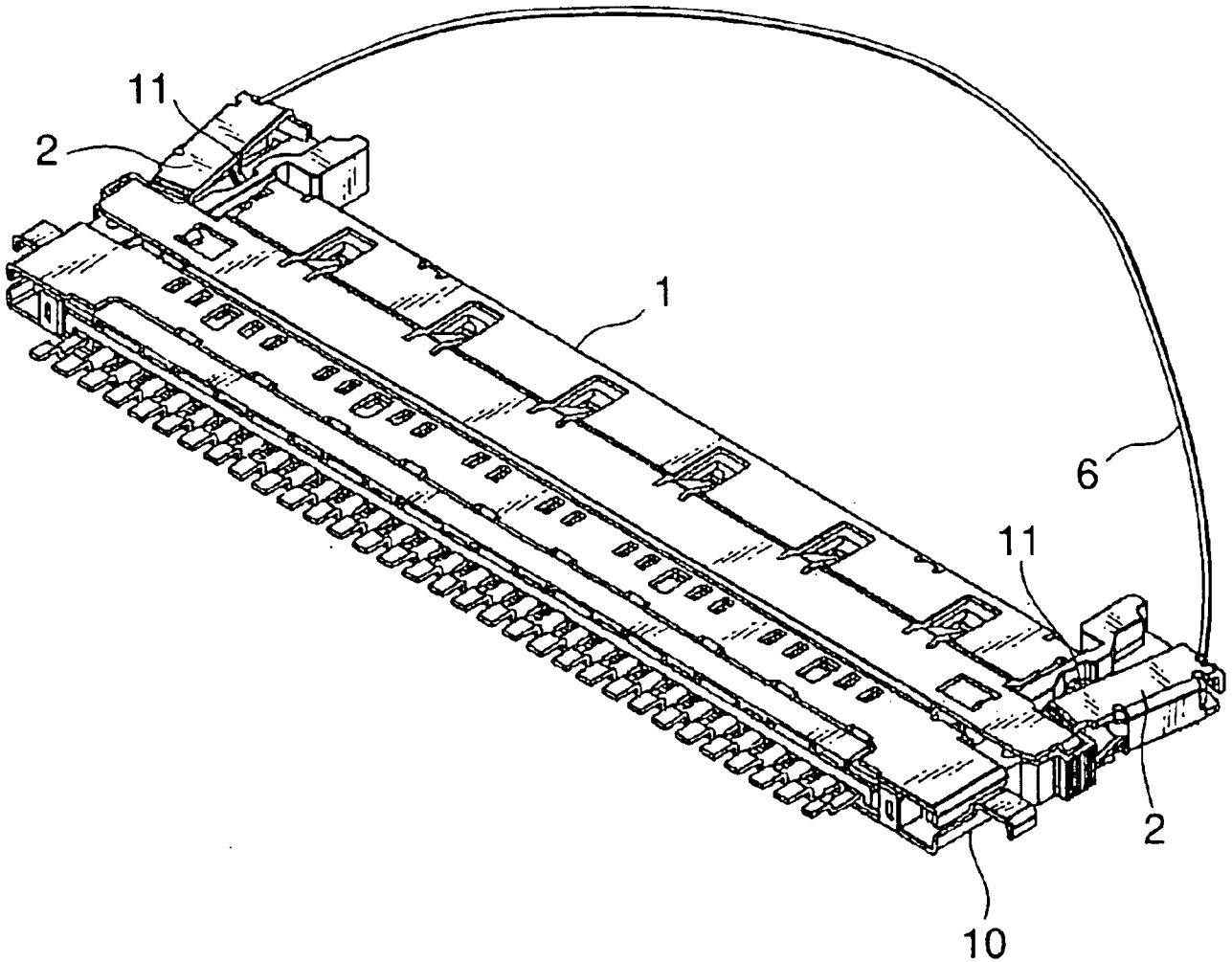
FIG. 5 is a perspective view showing the connector and the counterpart connector of FIG. 4 in a connected state.
Figure 6:
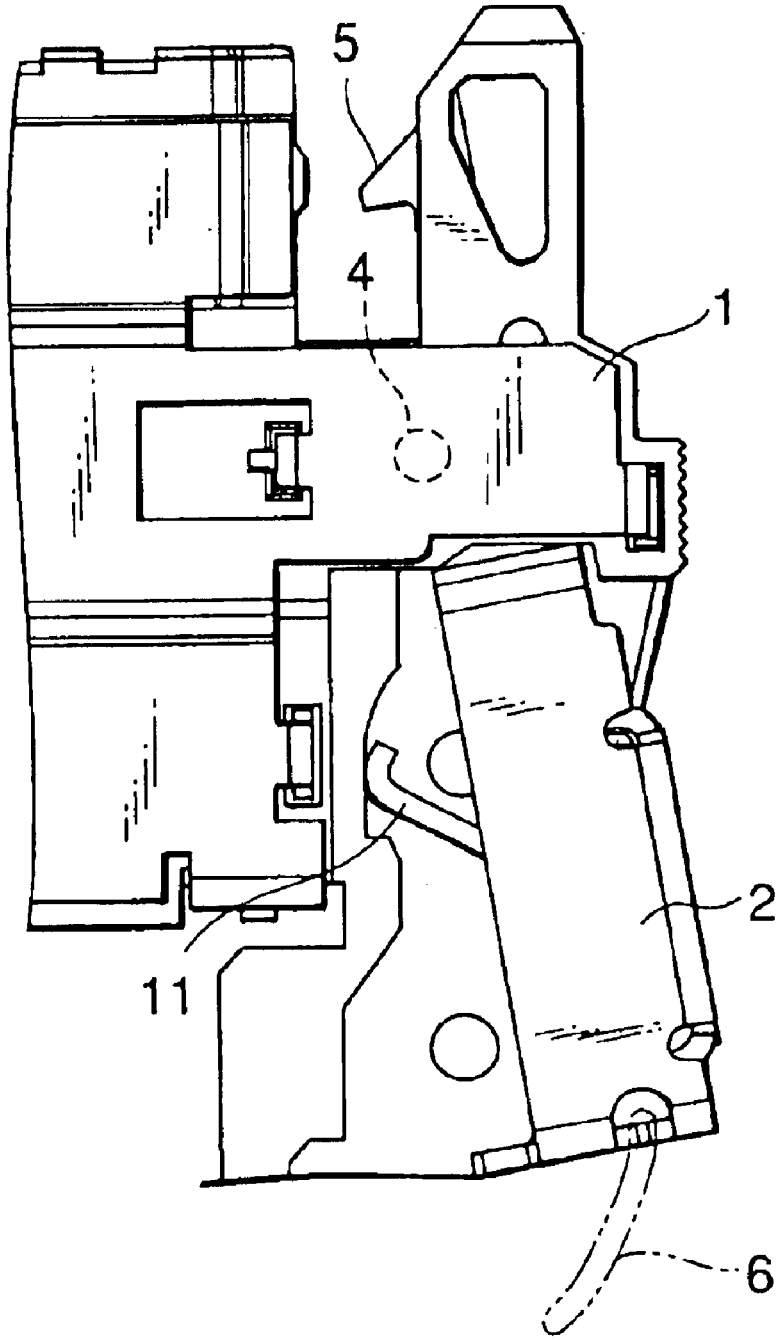
FIG. 6 is an enlarged plan view showing only the main part of the connector shown in FIG. 4.
Figure 7A:
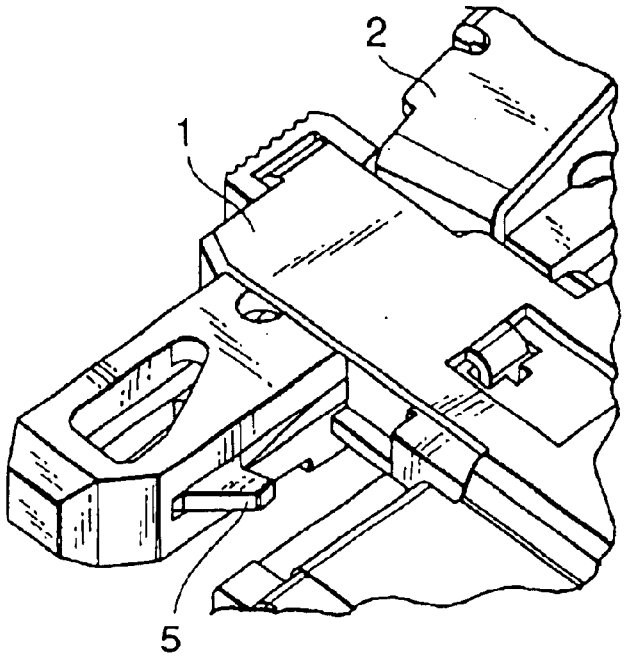
FIG. 7A is an enlarged perspective view showing only the main part of the connector shown in FIG. 4.
Figure 7B:
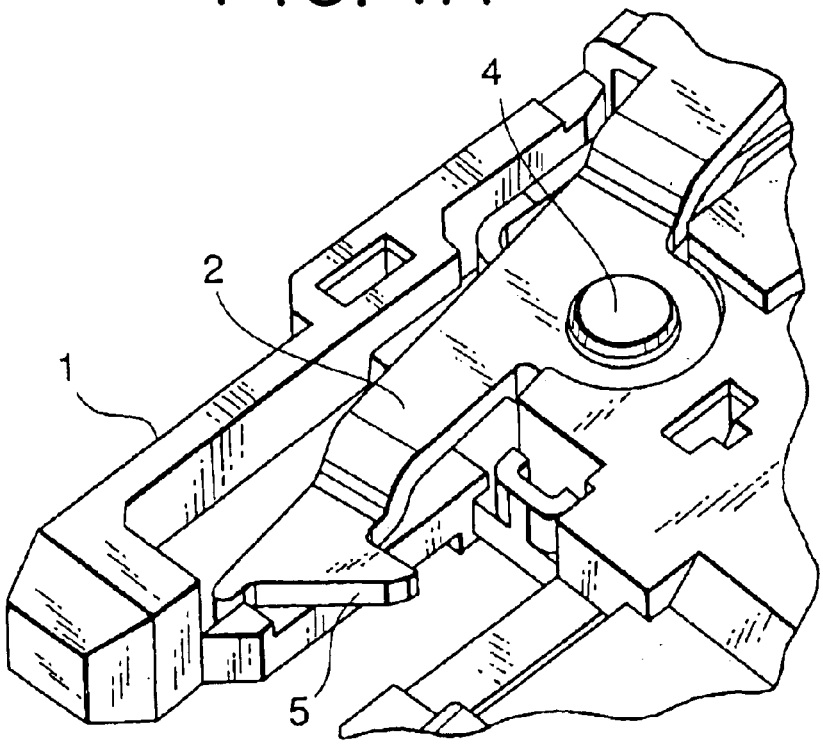
FIG. 7B is an enlarged perspective view showing an internal structure of the same main part of the connector as that shown in FIG. 7A.
Figure 8:
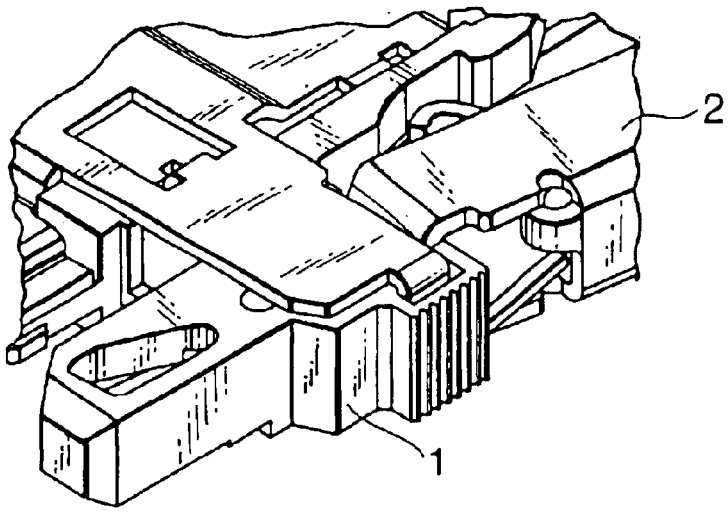
FIG. 8 is an enlarged perspective view of the same main part of the connector as that shown in FIGS. 7A and 7B, seen from a different angle.

When the connector body 1 interfits with the counterpart connector 10 for connection therebetween, tip portions of the lock levers 2 are inserted into lever receiving portions 12 of the counterpart connector 10. In the state where the interfitting connection is securely achieved as shown in FIG. 5, the engaging claws 5 of the lock levers 2 engage with concave portions or engaging portions (not shown) of the counterpart connector 10, thereby to securely inhibit disconnection between the connector body 1 and the counterpart connector 10. The engaging operation of the engaging claws 5 relative to the engaging portions is automatically performed in conjunction with a small pivotal motion of the lock levers 2 against the biasing force of the plate springs 11.

For detaching the connector body 1 from the counterpart connector 10, the center portion of the pull-tab 6 is pulled by fingers. In this event, by means of a component of the pulling force, each lock lever 2 makes a pivotal motion about a pivot axle 4 so as to release the engagement with the engaging portion of the counterpart connector 10, i.e. the locked state therebetween. Further, by another component of the pulling force, the connector body 1 is completely detached from the counterpart connector 10.

Figure 9:
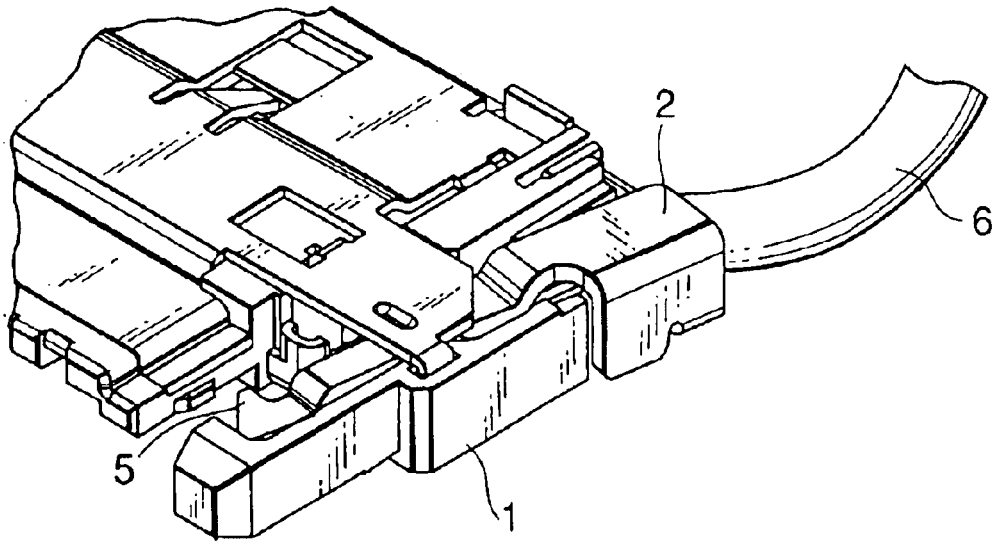
FIG. 9 is a perspective view showing only the main part of a connector provided with a lock release mechanism according to a fourth embodiment of the present invention.

As shown in a lock release mechanism according to a fourth embodiment of the present invention illustrated in FIG. 9, a pull-tab 6 may have a shape of a flat cable with a relatively large width. Further, the pull-tab 6 may have its both ends connected to pivotal ends of lock levers 2 in a sandwiched manner by caulking.

Figure 10:
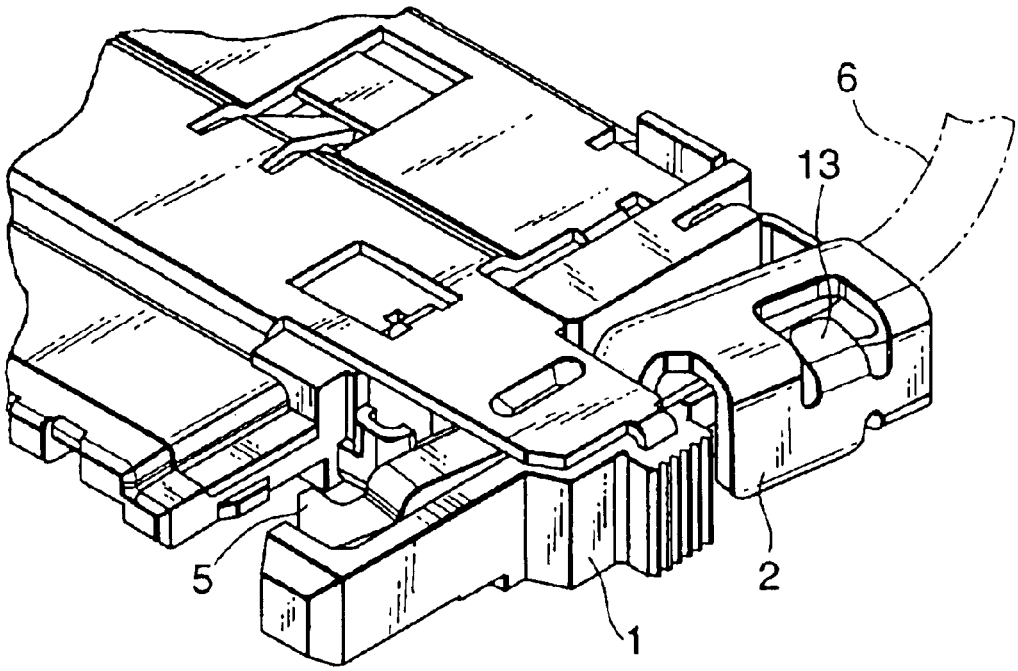
FIG. 10 is a perspective view showing only the main part of a connector provided with a lock release mechanism according to a fifth embodiment of the present invention.

On the other hand, as shown in a lock release mechanism according to a fifth embodiment of the present invention illustrated in FIG. 10, each lock lever 2 is provided at its pivotal end with a hook claw 13 for hooking a pull-tab 6 thereover to fix the pull-tab 6 to the lock levers 2.

The pull-tab may be fixed to the lock levers by adhesion other than soldering.

Further, the lock lever may be provided at one or each of the lateral ends of the connector body.

Figure 11:
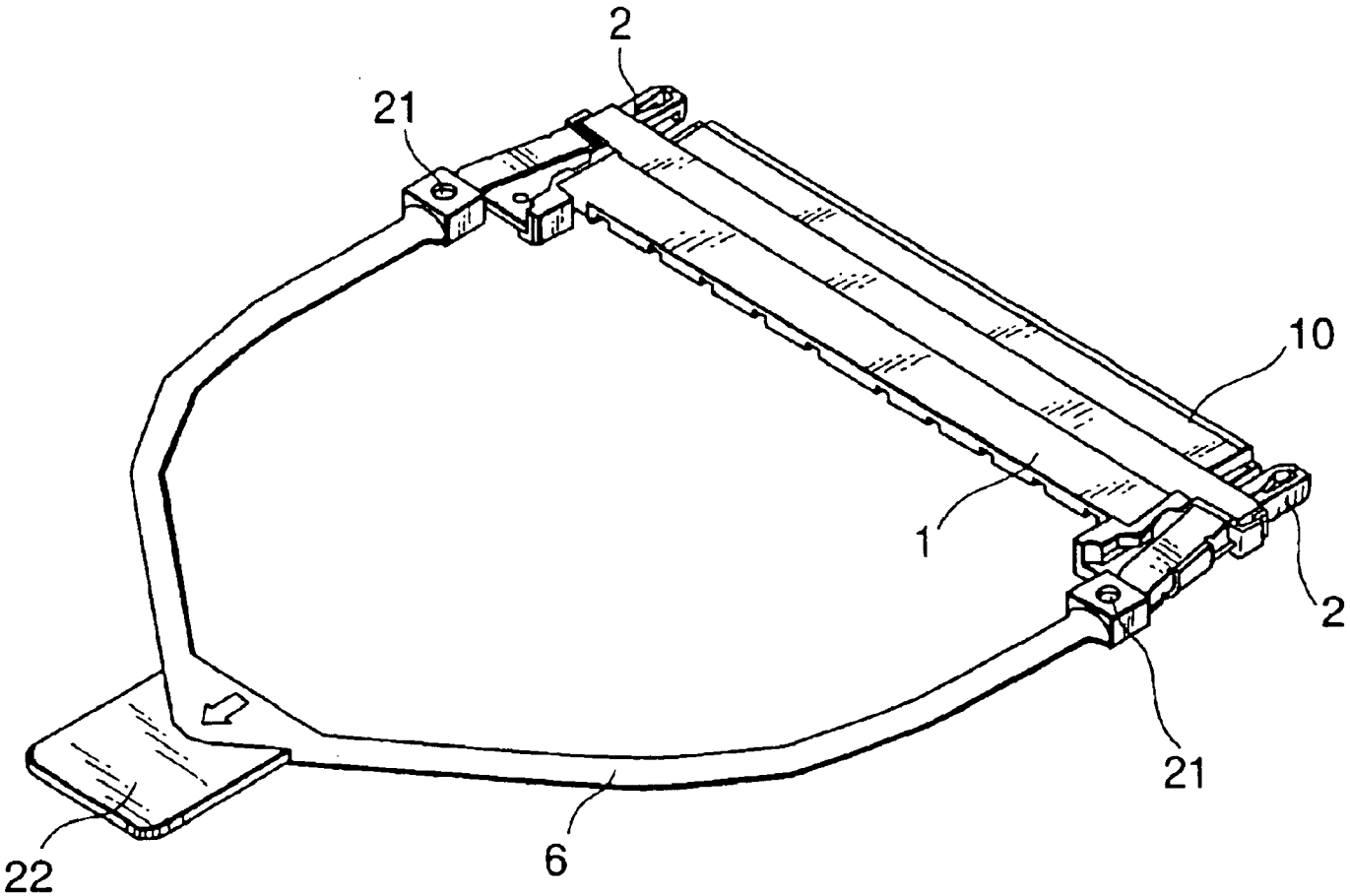
FIG. 11 is a perspective view showing a connector provided with a lock release mechanism according to a sixth embodiment of the present invention.

Referring now to FIG. 11, a connector having a lock release mechanism according to a sixth embodiment of the present invention will be described. The same or similar portions or components are assigned the same reference symbols so as to omit explanation thereof.

In the lock release mechanism of FIG. 11, a pull-tab 6 is in the form of a flexible thin cable and has its both ends connected pivotably to pivotal ends of a pair of lock levers 2 by means of fulcrum pins 21, respectively. The pull-tab 6 has a tab portion 22 integrally fixed thereto.

Referring to FIGS. 12A to 12C, 13A and 13B, an operation of the lock release mechanism of FIG. 11 will be described.

Figures 12A, 12B, 12C:
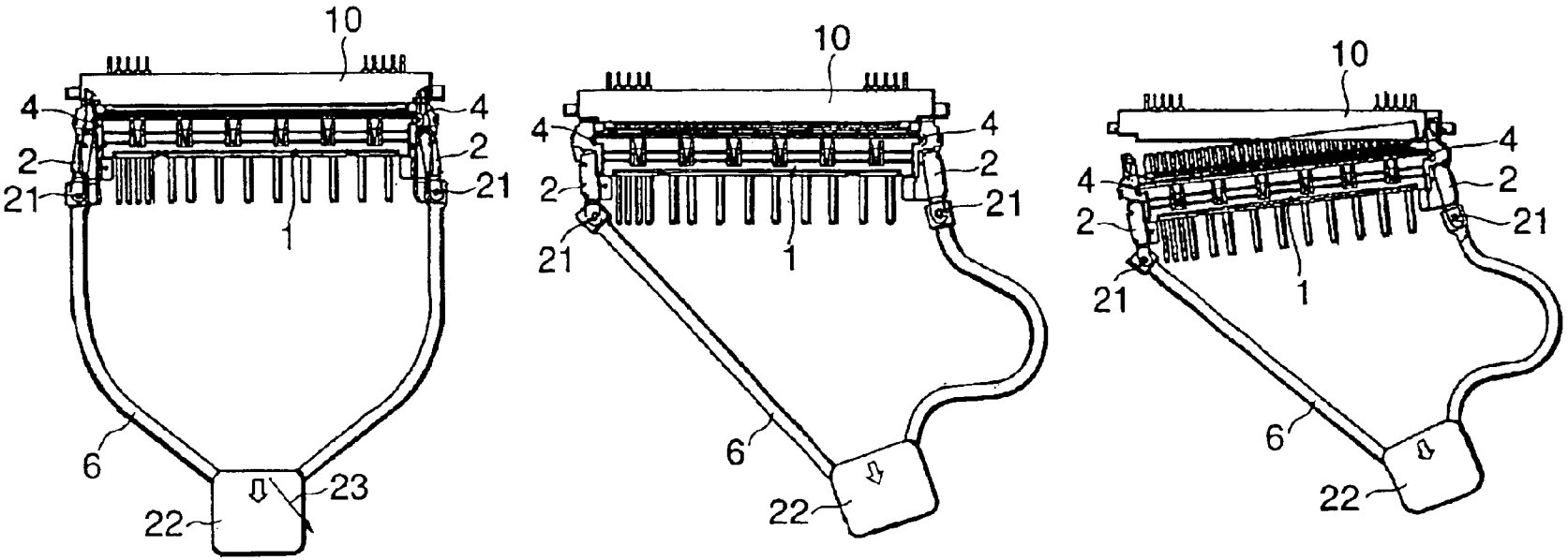
FIGS. 12A to 12C are diagrams for explaining an operation of the lock release mechanism shown in FIG. 11.

FIG. 12A shows the state where a connector body 1 is connected to a counterpart connector 10. For detaching the connector body 1 from the counterpart connector 10, the tab portion 22 is first pulled in a right oblique direction as identified by an arrow 23. Then, because the pull-tab 6 pulls the lock lever 2 on the left side of the tab portion 22 as shown in FIG. 12B, this left-side lock lever 2 pivots about a pivot axle 4 in a counterclockwise direction. As a result, the engagement with an engaging portion of the counterpart connector 10, i.e. the locked state, is released in the left-side lock mechanism. In this event, because the pull-tab 6 bends on the right side of the tab portion 22, no force is transmitted to the right-side lock lever 2, and thus the locked state with the counterpart connector is retained in the right-side lock mechanism. Therefore, as shown in FIG. 12C, the connector body 1 is partly detached from the counterpart connector 10.

Figure 13B:
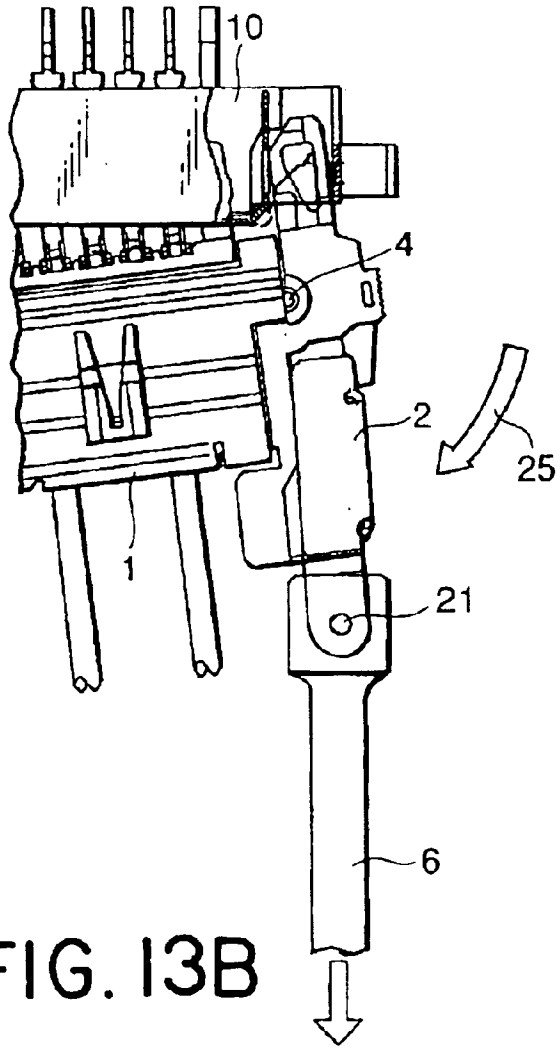
FIG. 13B is an enlarged view of the main part of FIG. 12C, showing the state after the pivotal motion of the lever.
Figure 13A:
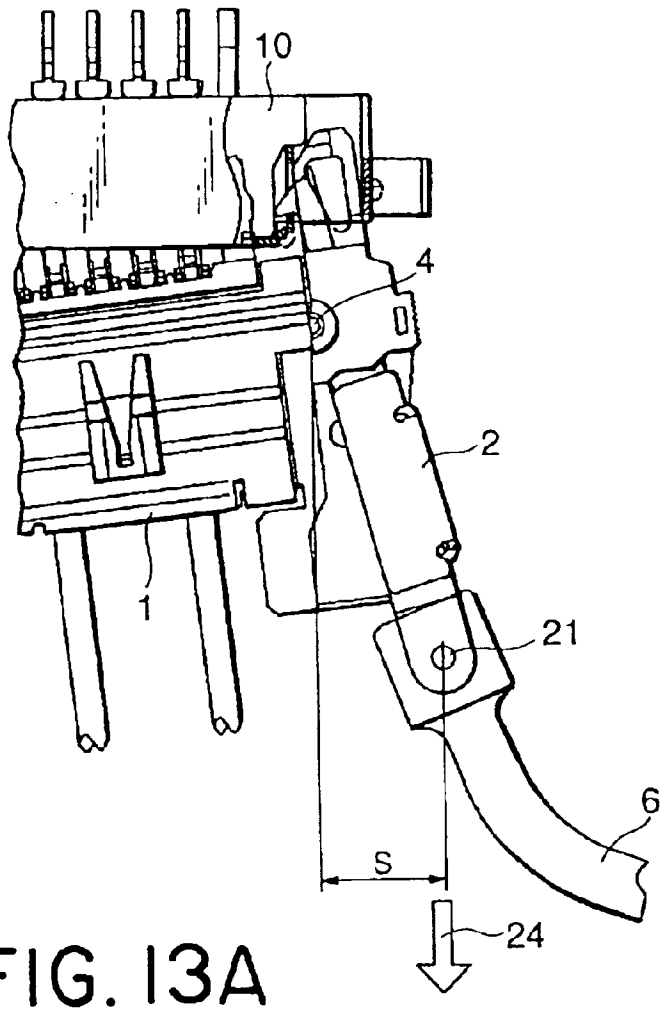
FIG. 13A is an enlarged view of the main part of FIG. 12C, showing the state before the pivotal motion of a lever.

In FIG. 13A showing a portion of FIG. 12C in an enlarged fashion, the pivot axle 4 of the lock lever 2 and the fulcrum pin 21 of the pull-tab 6 are spaced apart from each other by a distance S, i.e. eccentric to each other, in a direction (connector lateral direction) perpendicular to a direction in which the lock lever 2 engages with the counterpart connector 10. Accordingly, the pulling force in the right oblique direction, i.e. the force of the arrow 23 in FIG. 12A, is converted into a force of an arrow 24. By this force of the arrow 24, angular moment is exerted on the right-side lock lever 2 as shown by an arrow 25 in FIG. 13B so that the lock lever 24 pivots about a pivot axle 4 in a clockwise direction. As a result, the locking of the counterpart connector 10 is released also in the right-side lock mechanism. Thus, the connector body 1 can be completely detached from the counterpart connector 10.

Figure 14:
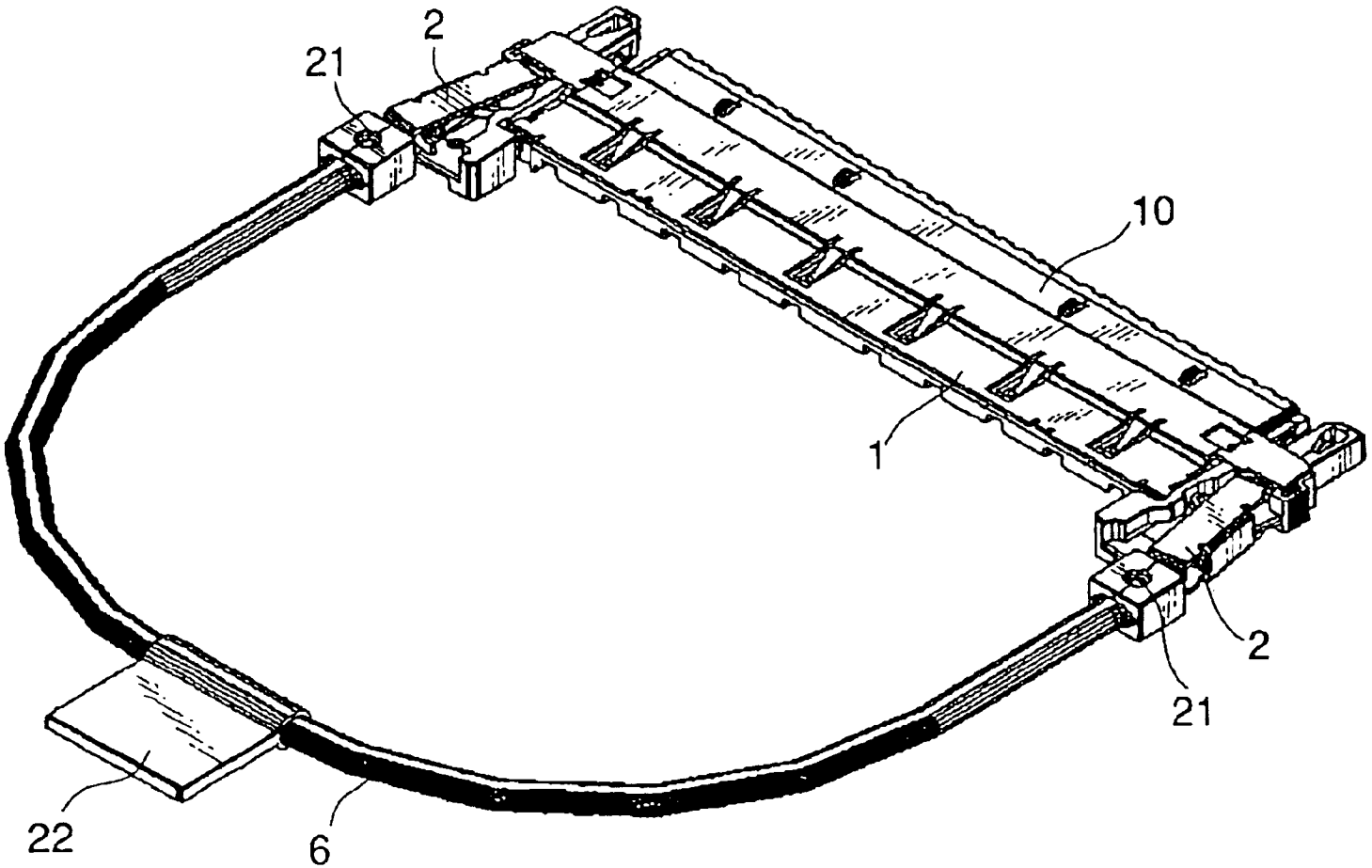
FIG. 14 is a perspective view showing a connector provided with a lock release mechanism according to a seventh embodiment of the present invention.

Referring now to FIG. 14, a connector having a lock release mechanism according to a seventh embodiment of the present invention will be described. The same or similar portions or components are assigned the same reference symbols so as to omit explanation thereof.

Figure 15:
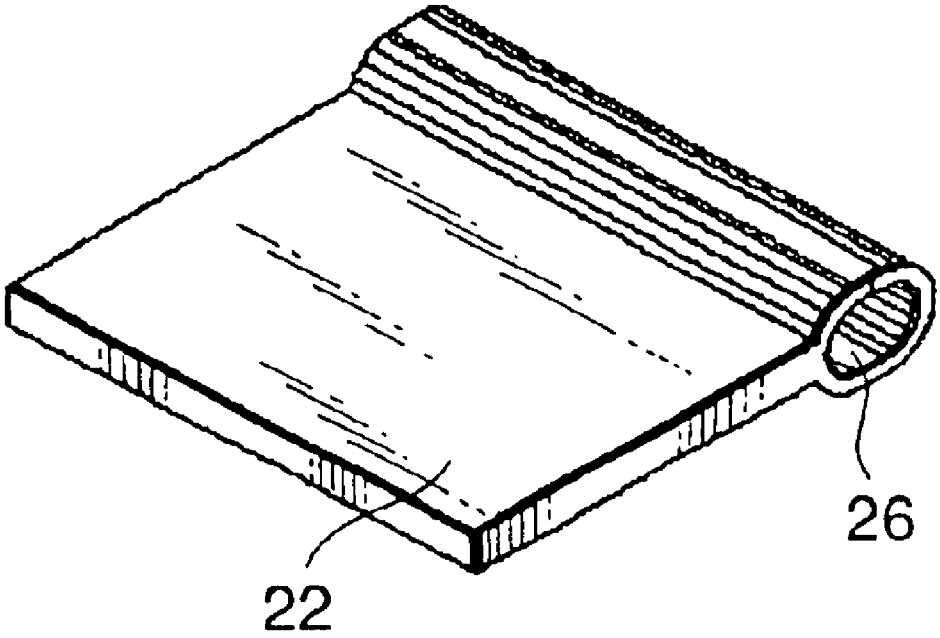
FIG. 15 is a perspective view showing a tab portion of a pull-tab of the lock release mechanism shown in FIG. 14.

In the lock release mechanism of FIG. 14, a tab portion 22 is prepared separately from a pull-tab 6 and slidably attached to the pull-tab 6. Specifically, the tab portion 22 has a guide hole 26 as shown in FIG. 15, and the pull-tab 6 is slidably inserted through the guide hole 26.

Figures 16A, 16B, 16C:
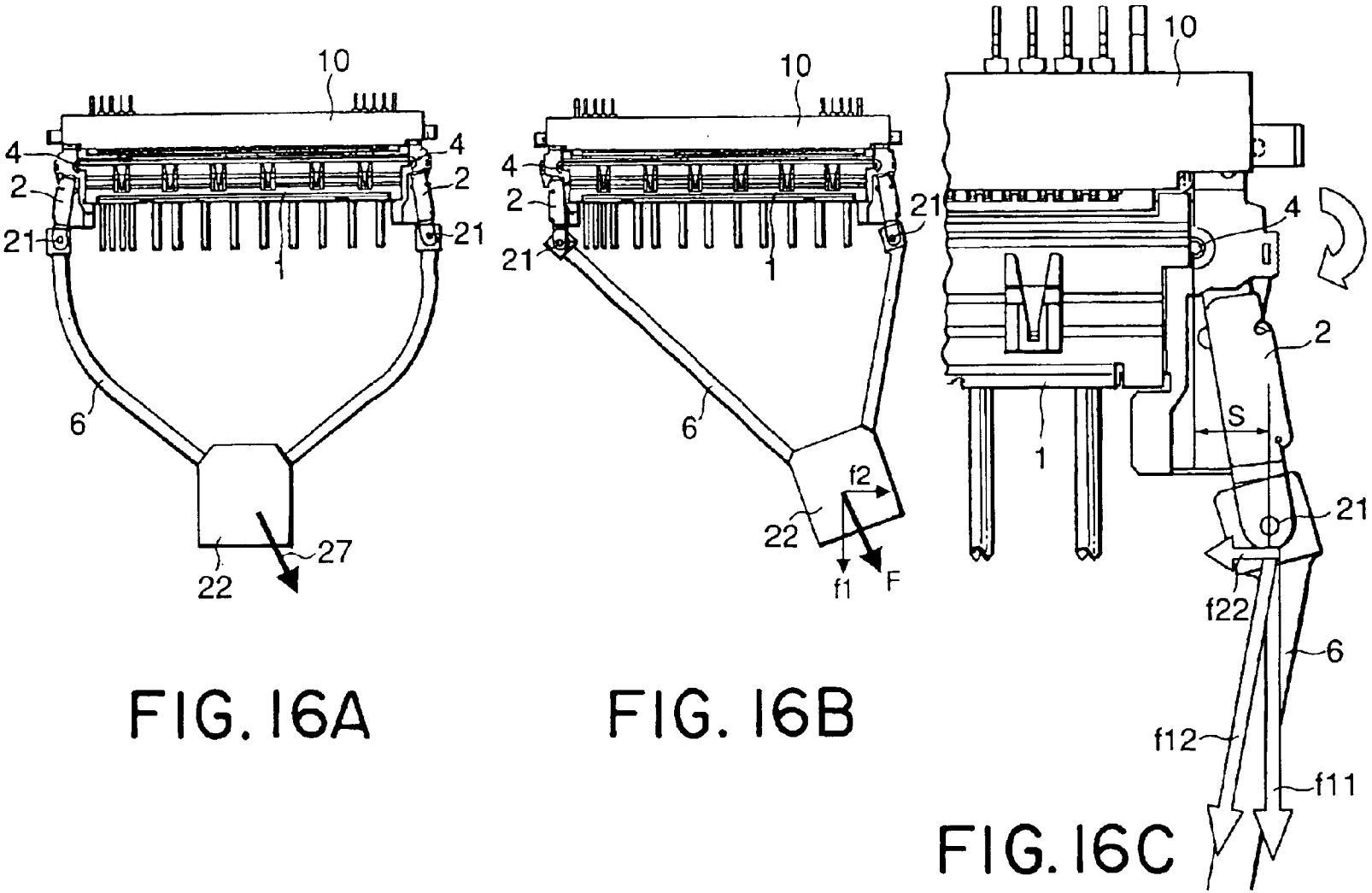
FIGS. 16A to 16C are diagrams for explaining an operation of the lock release mechanism shown in FIG. 14.

Referring to FIGS. 16A to 16C, an operation of the lock release mechanism of FIG. 14 will be described.

FIG. 16A shows the state where a connector body 1 is connected to a counterpart connector 10. For detaching the connector body 1 from the counterpart connector 10, the tab portion 22 is first pulled in a right oblique direction as identified by an arrow 27. Then, the tab portion 22 slides along the pull-tab 6 to reach a position as shown in FIG. 16B. In this event, a pulling force F is composed of a Y-direction component f1 and an X-direction component f2. By the X-direction component f2, a left-side lock lever 2 pivots about a pivot axle 4 in a counterclockwise direction to release the locked state with the counterpart connector 10.

On the other hand, as shown in FIG. 16C, a pivot axle 4 of a right-side lock lever 2 and a fulcrum pin 21 of the pull-tab 6 are spaced apart from each other by a distance S, i.e. eccentric to each other. Accordingly, the Y-direction component f1 is transmitted to the fulcrum pin 21 of the pull-tab 6 as a force f11, and further, by a force f12 parallel to the pull-tab 6, a force f22 is exerted in the X direction, so that angular moment is generated. By this angular moment, the right-side lock lever 2 pivots about the pivot axle 4 in a clockwise direction to release the locked state with the counterpart connector 10. In this embodiment, the tab portion 22 can freely move along the pull-tab 6, and thus the force f12 can be always generated when the tab portion 22 is pulled. As a result, the secure lock release can be ensured even if the tab portion is pulled obliquely.

After all, the locking of the counterpart connector 10 is released in both right-side and left-side lock mechanisms. Accordingly, the connector body 1 can be completely detached from the counterpart connector 10.

According to each of the foregoing various lock release mechanisms, the operability is remarkably improved upon releasing the locked state while the high density assembling of the components or devices is maintained. Thus, those lock release mechanisms are suitable to be mounted on high density assembling portions of display units, DVCs, PCs and the like.

In the foregoing description, explanation has been made of the connector as an example, while the present invention is similarly applicable to other components and various kinds of devices. Specifically, the present invention is applicable to, for example, those members having a lock structure such that the members have at least a pair of concave and convex portions and are capable of being attached to and detached from each other, one of the members has a lock lever on at least one of lateral sides thereof, and the other of the members has an engaging portion, such as a concave portion or a hole, for retaining the lock lever, wherein an attached state is retained through engagement between a projection of the lock lever and the engaging portion, while the engagement between the projection of the lock lever and the engaging portion is released to enable detaching of the members from each other by pulling an operating portion of the lock lever.

What is claimed is:

1. A lock release mechanism for releasing an engagement of a body component with a counterpart member by moving a lock mechanism engaging with said counterpart member, said lock release mechanism comprising:

a lock lever connected to said lock mechanism;

a pivot axle connecting said lock lever to said body component so that said lock lever is pivotable relative to said body component; and a flexible pull-tab connected to said lock lever, said lock mechanism being moved in accordance with pivoting of said lock lever caused by a force pulling said pull-tab, thereby to release the engagement with said counterpart member.

2. The lock release mechanism according to claim 1, wherein a direction of the force pulling said pull-tab is designed to coincide with a direction in which said lock mechanism is detached from said counterpart member.

3. The lock release mechanism according to claim 1, wherein a direction of the force pulling said pull-tab is designed to differ from a direction in which said lock mechanism is detached from said counterpart member.

4. The lock release mechanism according to claim 1, wherein said lock mechanism is formed integral with said body component attached to said counterpart member, said lock mechanism being movable relative to said body component.

5. The lock release mechanism according to claim 4, wherein said body component is designed so as to be detached from said counterpart member in a first direction, said lock mechanism being movable in a second direction perpendicular to said first direction, said pull-tab being designed so as to be pulled in said first direction.

6. The lock release mechanism according to claim 4, wherein said body component is designed so as to be detached from said counterpart member in a first direction, said lock mechanism being movable in a second direction perpendicular to said first direction, said pull-tab being designed so as to be pulled in a third direction parallel to and opposite to said second direction.

7. The lock release mechanism according to claim 1, wherein said lock mechanism is a member separated from said body component confronting said counterpart member, said lock mechanism being attached movably to said body component, said pull-tab being connected to said lock mechanism.

8. The lock release mechanism according to claim 7, wherein said lock mechanism is attached pivotably to said body component.

9. The lock release mechanism according to claim 8, wherein said lock mechanism is rotated by the force pulling said pull-tab, thereby to release the engagement with said counterpart member.

10. The lock release mechanism according to claim 7, wherein said lock mechanism is attached slidably to said body component.

11. The lock release mechanism according to claim 10, wherein said lock mechanism slides by the force pulling said pull-tab, thereby to release the engagement with said counterpart member.

12. The lock release mechanism according to claim 1, wherein said pull-tab has a semicircular shape.

13. The lock release mechanism according to claim 1, wherein said pull-tab is formed integral with said lock mechanism.

14. The lock release mechanism according to claim 1, wherein said pull-tab is formed separately from said lock mechanism.

15. The lock release mechanism according to claim 14, wherein said pull-tab is fixed to said lock mechanism by soldering.

16. The lock release mechanism according to claim 14, wherein said pull-tab is fixed to said lock mechanism by caulking.

17. The lock release mechanism according to claim 14, wherein said pull-tab is fixed to said lock mechanism by hooking.

18. The lock release mechanism according to claim 1, wherein said pull-tab is pivotably connected to said lock mechanism.

19. The lock release mechanism according to claim 18, wherein said lock mechanism comprises a lock lever retained pivotably about a pivot axis, and the pivot axis of said lock lever and a pivot axis of said pull-tab are eccentric to each other in a direction perpendicular to an engaging direction of said lock mechanism.

20. The lock release mechanism according to claim 18, further comprising a tab portion slidably arranged on said pull-tab.

21. A lock release mechanism for releasing an engagement of a body component with a counterpart member by moving two movable lock mechanisms engaging with said counterpart member, said lock release mechanism comprising:

a pair of lock levers connected to said lock mechanisms, respectively;

a pair of pivot axles connecting said lock levers to said body component, respectively, so that said lock levers are pivotable relative to said body component; and a pull-tab in the form of a flexible elongate member having both ends connected to said two lock mechanisms, respectively, said lock mechanisms being moved in accordance with pivoting of said lock levers caused by components of a force pulling said pull-tab, thereby to release the engagement with said counterpart member.

22. The lock release mechanism according to claim 21, wherein a direction of the force pulling said pull-tab is designed to coincide with a direction in which at least one of said lock mechanisms is detached from said counterpart member.

23. A connector comprising:

a connector body for connecting to a counterpart connector;

a mechanism connected to said connector body for engaging with said counterpart connector, said mechanism serving as the lock mechanism described in claim 1; and the lock release mechanism.

24. A lock release mechanism for releasing an engagement of a body component with a counterpart member by moving a lock mechanism engaging with said counterpart member, said lock release mechanism comprising:

a lock lever connected to said lock mechanism;

a pivot axle connecting said lock lever to said body component so that said lock lever is pivotable relative to said body component;

a pull-tab pivotally connected to said lock mechanism; and a tab portion slidably arranged on said pull-tab wherein said pull tab is connected to said lock lever, said lock mechanism being moved in accordance with pivoting of said lock lever caused by a force pulling said pull-tab, thereby to release the engagement with said counterpart member.

* * * * *